US005089797A

United States Patent [19]

Grunert et al.

[11] Patent Number: 5,089,797

[45] Date of Patent: Feb. 18, 1992

[54] CIRCUIT BREAKER WITH DUAL FUNCTION ELECTROMAGNETIC TRIPPING MECHANISM

[75] Inventors: Kurt A. Grunert, Beaver; Jeffrey S. Gibson, Aliquippa; John A. Wafer, Brighton Township, Beaver County, all of Pa.

[73] Assignee: Westinghouse Electric Corp., Pittsburgh, Pa.

[21] Appl. No.: 612,380

[22] Filed: Nov. 14, 1990

[51] Int. Cl.[5] ..... H01H 9/00

[52] U.S. Cl. ..... 335/172; 335/190

[58] Field of Search ..... 335/21-23, 335/38-45, 167-175, 185-192

[56] References Cited

U.S. PATENT DOCUMENTS

| | | | |
|---|---|---|---|
| 3,638,157 | 1/1972 | Kruzic . | |
| 3,731,239 | 5/1973 | Ellenberger | 35/168 |
| 3,863,042 | 1/1975 | Nicol . | |
| 4,001,743 | 1/1977 | Arnhold . | |
| 4,503,408 | 3/1985 | Mrenna . | |
| 4,654,614 | 3/1987 | Chien . | |
| 4,697,163 | 9/1987 | Grunert . | |
| 4,725,799 | 2/1988 | Bratkowski . | |
| 4,808,952 | 2/1989 | Berner et al. | 335/41 |

*Primary Examiner*—Gerald P. Tolin
*Assistant Examiner*—Lincoln Donovan
*Attorney, Agent, or Firm*—M. J. Moran

[57] ABSTRACT

A circuit breaker embodies with a single electromagnetically actuated plunger two levels of actuation, corresponding to two levels of excessive current or voltage defined by two different airgaps, one at the lower level for triggering the toggle mechanism, the other at the higher level for directly actuating the movable arm through a kicker arm. The preferred embodiment provides a double-ended lever pulled by the plunger at midpoint for actuating the trip bar, and the kicker arm is actuated in an overriding situation by the lever rotating about the trip bar blocked at the end of its initial move.

8 Claims, 5 Drawing Sheets

CIRCUIT BREAKER WITH DUAL FUNCTION ELECTROMAGNETIC TRIPPING MECHANISM

FIELD OF INVENTION

The invention relates to circuit breakers in general and, more particularly, to the operating electromagnetic mechanism of a circuit breaker in relation to motor circuit protection.

BACKGROUND OF THE INVENTION

Circuit breakers are electromagnetically controlled to react upon a critical magnitude of the current so as to open the electrical contacts interconnecting the power supply and the load, whenever there is an excess of current flowing through the load, or derived from the power supply. In the process, two alternative steps may be taken by the circuit breaker which correspond to different degrees of urgency. One is to cause a response to an overload which will trigger a predetermined succession of mechanical steps for disconnecting the movable contact from the stationary contact. The other is to ensure a direct and immediate disconnection between the contacts if the size of the current indicates a condition serious enough, such as a short-circuit, to require immediate action.

U.S. Pat. Nos. 3,863,042 and 4,001,743 show electromagnetic actuation of a linkage mechanism kicked by the coil armature for tripping a circuit breaker. Slow operation is generally initiated by a bimetal, whereas instant command to separate the movable contact from the fixed contact of the circuit breaker is obtained with a kicker arm stricken by the electromagnetic coil armature and striking the movable contact away, as shown in U.S. Pat. No. 4,654,614. U.S. Pat. No. 4,503,408 illustrates trip bar rotation for actuating a toggle mechanism to separate the contacts.

Where a circuit breaker is used with a motor-starter, there is a need to foresee two possibilities:

1) the immediate control of the circuit breaker upon a serious overload, such as a voltage surge or a short-circuit, and 2) circuit breaker operation upon an over-current which should not last for the motor because of heating, despite the much lower level of the critical current.

If the trip bar is set for actuation at the lower critical level, for quick action it will work only at the much higher critical level required in the second situation. In this respect, U.S. Pat. No. 4,042,895 shows a combination motor-starter circuit breaker wherein the three functions of motor starting, circuit interruption and current limiting have been separately provided for. U.S. Pat. No 4,697,163 shows an electromagnetic coil with a plunger action determined by an airgap selected for the rest position, so as to establish a delay under overcurrent which will be caused by the biasing spring before and the striking arm can hit the trip bar of the circuit breaker and release the toggle mechanism to separate the circuit breaker contacts.

It is desirable to combine more closely in a circuit breaker the separate functions of:

1) responding immediately to an excessive current or voltage, and 2) of reacting to an overload as can be experienced when an AC motor is working with a load under the AC supply lines.

Such closer combination should be so achieved as to simplify the mechanical and the electromagnetic design within the housing of a circuit breaker, while allowing to perform any of the several required functions to be exerted upon the movable contact in response to various possible load conditions.

SUMMARY OF THE INVENTION

The present invention resides in using a single electromagnetic device to provide either the tripping function or the kicking function of a circuit breaker.

The circuit breaker includes:

- a fixed and a movable contact connected between a power terminal and a load terminal:
- a movable arm carrying the movable contact;
- a toggle mechanism for moving the movable arm from a rest position;
- a trip bar operative from a rest position to a limit position for actuating, through the toggle mechanism, the movable arm away from its rest position, thereby to disconnect the power terminal from the load terminal upon the occurrence of an overload.

According to the present invention, an arm member is mounted for concurrent rotative movement with the movable arm. One strike end of the arm member is held by a bias-spring which will yield upon actuation of the movable arm under the toggle mechanism. Also according to the present invention, an electromagnetic coil surrounds a plunger axially movable therein from a larger airgap, when at rest, to a smaller airgap for a level of overcurrent and to a zero airgap for a more excessive current upon the coil. With the smaller airgap, the plunger activates the trip bar and therethrough the toggle mechanism of the circuit breaker. With the zero airgap, the plunger activates directly the movable contact arm, preferably through a arm member.

According to a preferred embodiment of the invention, the plunger has an active end used as a pivot for a double-ended lever arm; the lever arm has a first end resting against the trip bar in its rest position and a second end resting upon the spring-biased strike end of the arm member. The spring-biased strike end is kicked by the second end of the lever arm when pivoting about its first end, once the plunger has reached the zero airgap. This pivoting about the first end is due to a stopper blocking the trip bar to a limit position serving as the pivotal point. If the overcurrent is of lesser amplitude, the airgap is only smaller and the trip bar reaching the stopper will actuate the toggle mechanism and separate the contacts of the circuit breaker in due time.

DETAILED DESCRIPTION OF THE INVENTION

Figure 1:
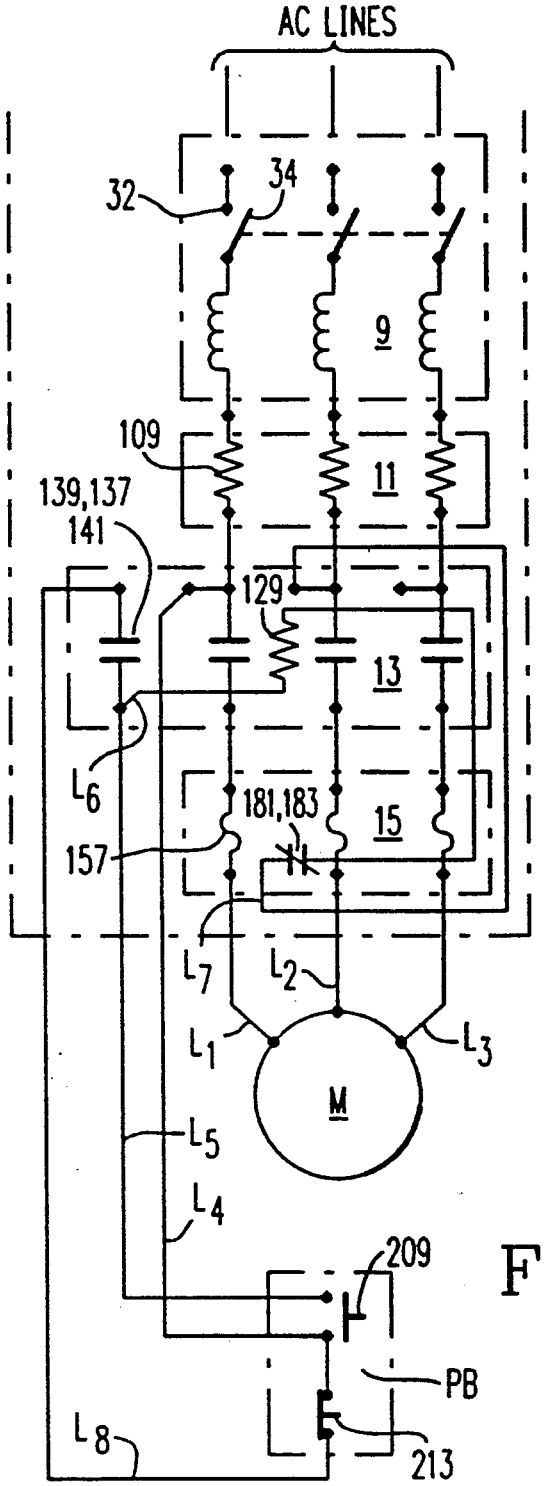
FIG. 1 is a wiring diagram of a motor-starter combination with current interrupting capacity.

FIG. 1, taken from U.S. Pat. No. 3,638,157, shows a circuit breaker 9 inserted between the AC lines of the power supply and an AC motor M. The circuit breaker is illustrated as of the three-pole type, having for each pole a fixed contact 32 and a movable contact 34. A fuse unit 11 is also shown inserted after the circuit breaker, with its fuses 109. Thereafter is shown a push-button PB used to close contacts 137, 139 and 141 associated with a contactor 13, as a starter unit to connect the AC lines to the respective phase lines L1, L2, L3 of the motor. As described in the U.S. Pat. No. 3,638,157, the object, there, is to actuate the circuit breaker under electromagnetical tripping in accordance with a selected range of adjustment of the tripping characteristics of the circuit breaker.

Figure 2:
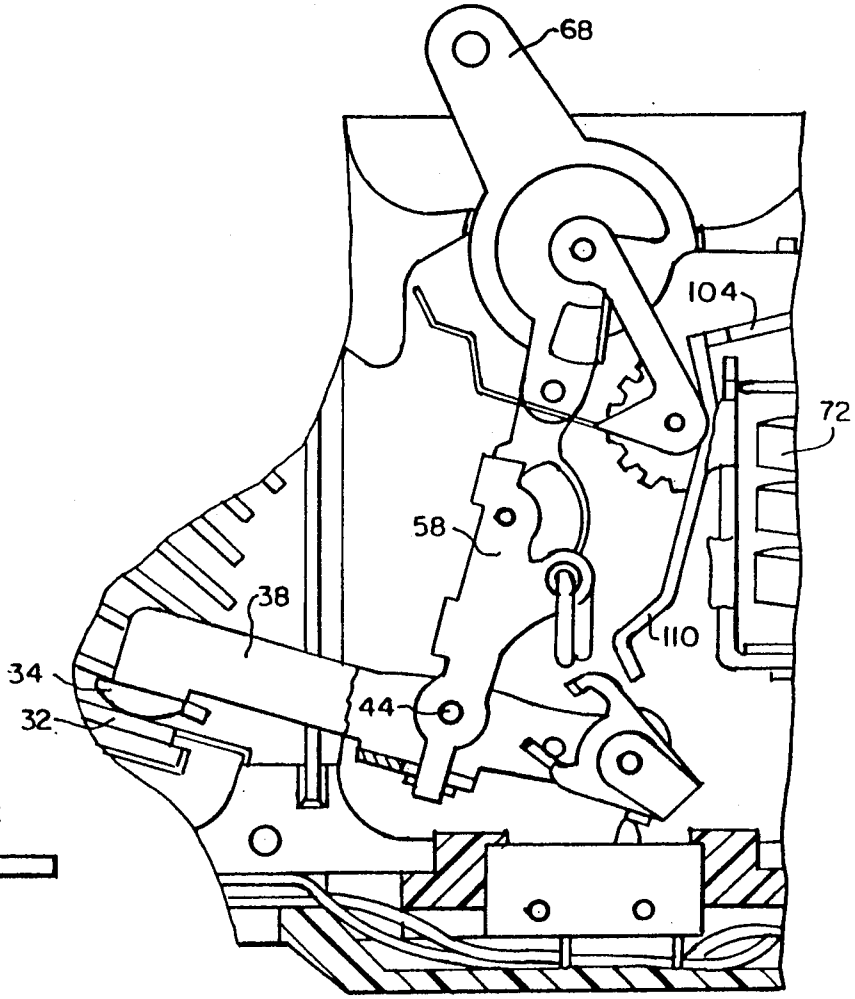
PRIOR ART FIG. 2.
FIG. 2 is a side elevation of a circuit breaker showing the toggle mechanism thereof associated with a triggering coil and armature combination for the movable arm of the breaker.

FIG. 2, taken from U.S. Pat. No. 3,863,042, shows a circuit breaker having a movable arm 38 controlled by a toggle mechanism having its knee 112 displaced by the arm 110 of the armature 104 of a coil 72, whenever energized so as to pull the movable arm 38 up with the pivot 44 which is the connection with the under toggle link 58. The U.S. Pat. No. 3,863,042 patent is hereby incorporated by reference.

Figure 4:
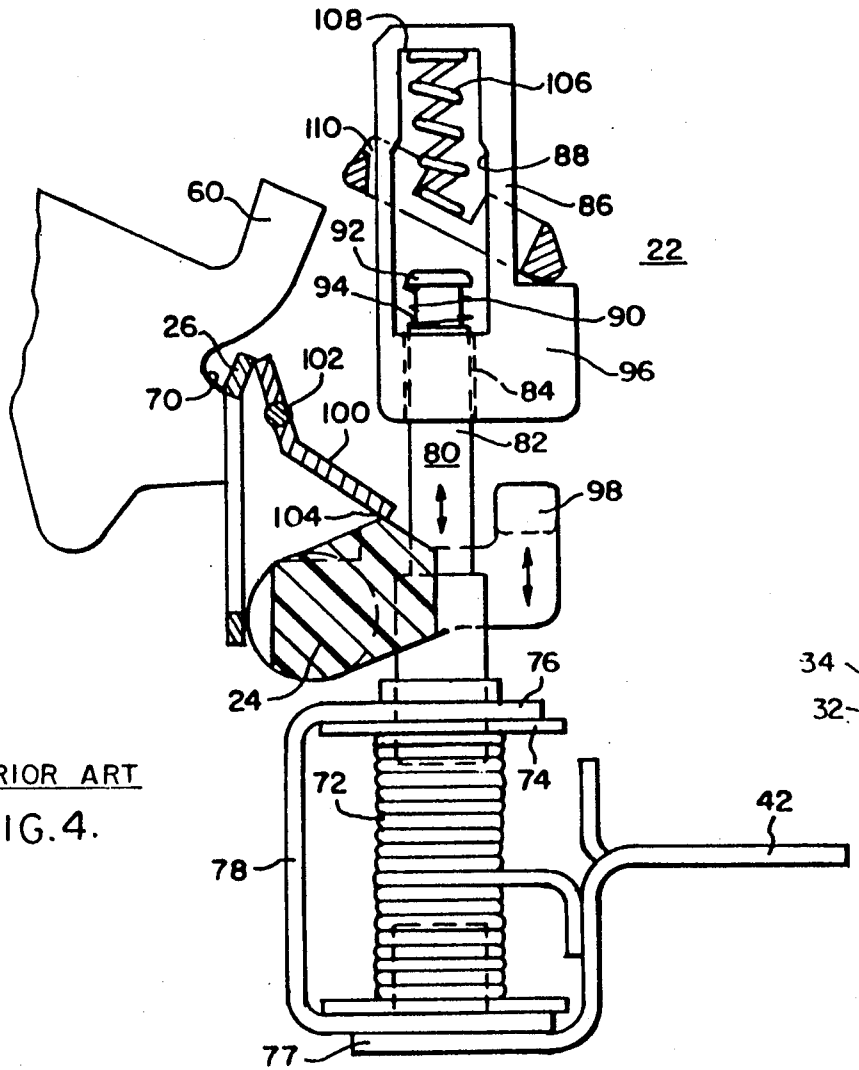
PRIOR ART FIG. 4.
FIG. 4 is a view of the electromagnetic means of FIG. 3 with its delay mechanism.
Figure 3:
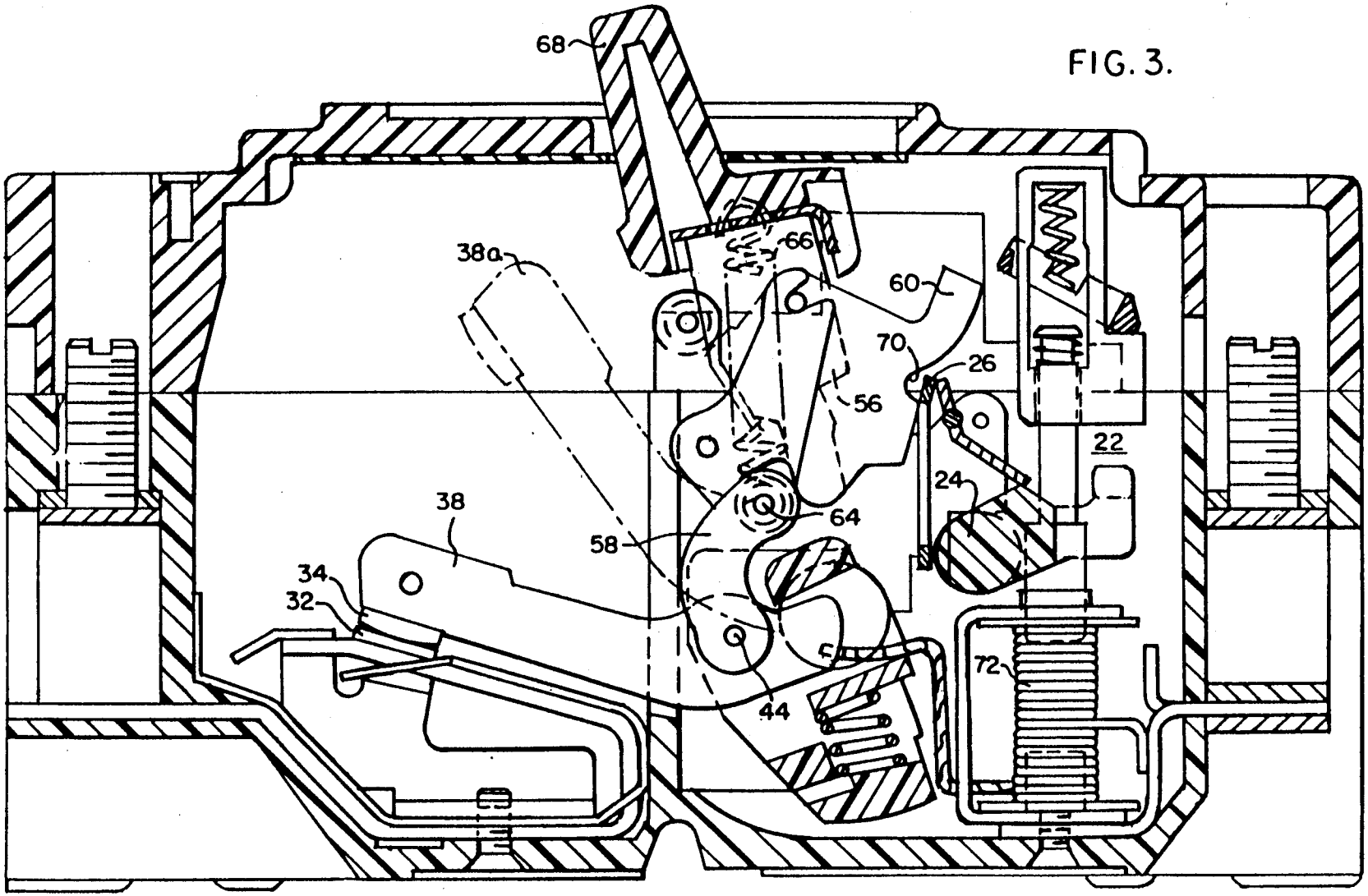
FIG. 3 is a vertical sectional view of a circuit breaker embodying electromagnetic means for triggering the trip bar thereof and through a toggle mechanism for actuating the movable arm of the breaker.

FIG. 3 is taken from U.S. Pat. No. 4,697,163 which is hereby incorporated by reference. The circuit breaker is shown in the closed position. The movable contact 34 is applied by the arm 38 onto the fixed contact 32. A toggle mechanism is shown with upper toggle link 56 and lower toggle link 58. The latter, as in FIG. 2, is connected by a pivot 44 to the movable arm 38. The pivot 64 common to the two toggle links is connected through a compression spring to the arm of the handle 68. A releasable cradle member 60 is connected to the upper toggle link for actuation when unlatched at 70 by a latch lever 26. This actuation is caused by the rotation of a trip bar 24 when the latter is hit by an electromagnetic mechanism 22 energized in its coil 72 when there is an overcurrent requiring separation of contacts 34 and 32. FIG. 4 shows with more details the action of the electromagnetic mechanism 22. When an overcurrent of a predetermined magnitude occurs, coil 72 exerts enough force to pull plunger 82 downward. The plunger carries a hammer 96 which in the rest position is at a predetermined distance from an arm 98 belonging to the trip bar 24. When the plunger is pulled by coil 72, hammer 96 hits arm 98 and forces the trip bar 24 to rotate clockwise, whereby a lever 100 pivots about its axis 102 and liberates the latch lever 26 of the cradle.

FIG. 4 also shows that the hammer 96 is carried by the free end of plunger 82, with a play allowed to intervene with a spring 106 biasing a stopper 110 so as to regulate the delay at which stopper and spring no longer allow hammer 96 to yield upon impact by arm 98 and the ,latter becomes effective in moving the trip bar and in actuating. the toggle mechanism. Thus, FIGS. 3 and 4 disclose an installed delay between trip time and current. It is also shown in the incorporated by reference U.S. Pat. No. 4,697,163 that such a delay can be made adjustable by mechanical adjustment of the tension left in the biasing spring 106 from the point when the hammer engages the trip bar arm 98.

Figure 5:
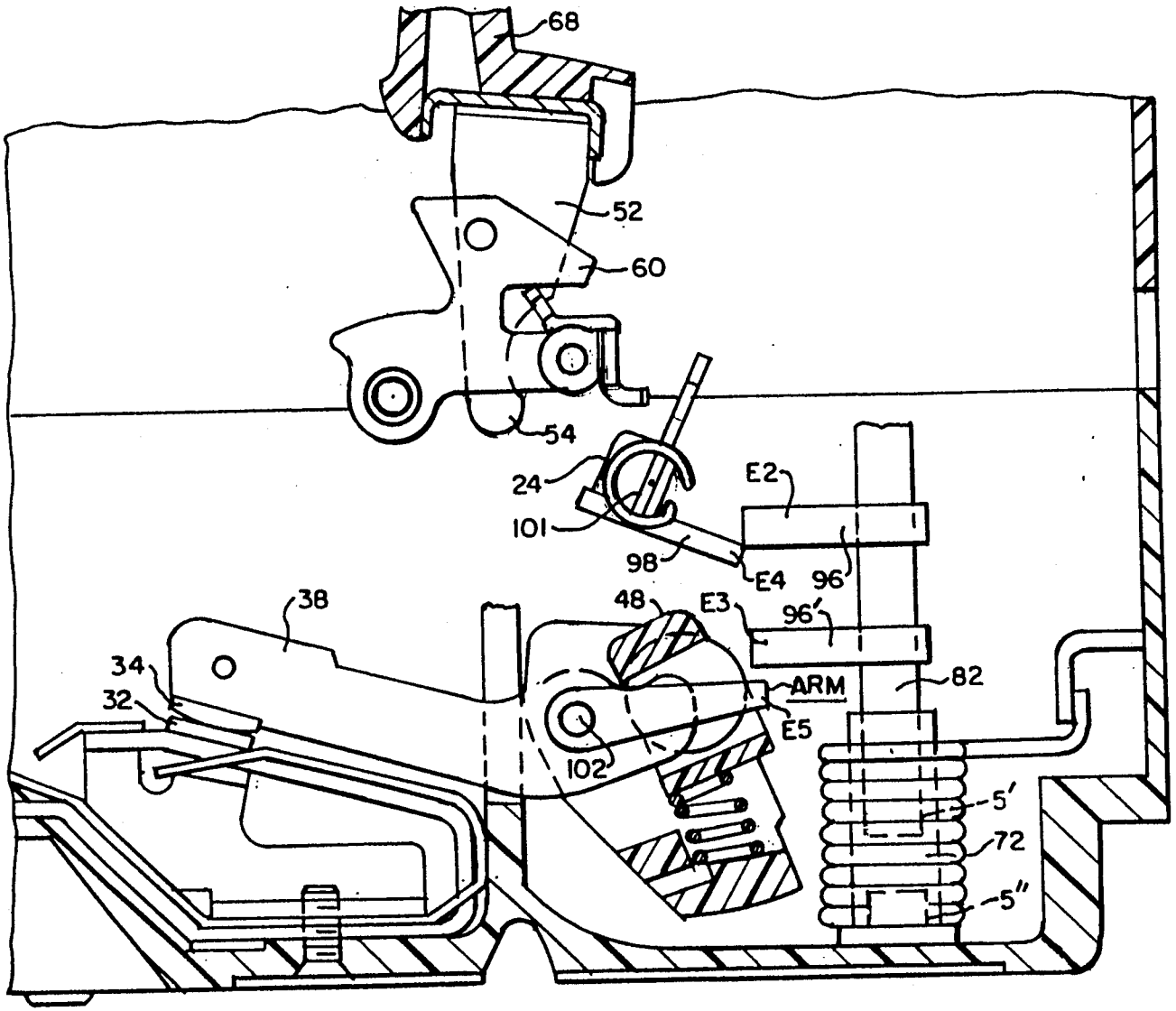
FIG. 5 is a view of the circuit breaker according to the present invention illustrated with electromagnetic means like in FIG. 4 having an overriding arm member actuated upon the critical occurrence of an event requiring prompt action with the moving arm of the breaker.

FIG. 5 shows the circuit breaker of FIG. 3 amended, according to the present invention, by adding:

1) an arm member ARM mounted on the moving arm 38 of the circuit breaker, and
2) another hammer 96′ mounted on plunger 82 further down along the distance of travel behind hammer 96.

Plunger 82 will be pulled down by an overcurrent on coil 72 to the point when the rear end 5′ of the plunger leaves, with the abutting end 5″ deep in the coil, an airgap which is smaller than at rest. In so doing, hammer 96, will with its striking end E2, force down the end E4 of the trip bar arm 98, thereby rotating the trip bar 24 about its axis 101 and causing unlatching of the toggle mechanism, as between 26 and 70 in FIG. 3. However, should the overcurrent on coil 72 be much more, plunger 82 will close the airgap between 5 and 5′. At this time, hammer 96′ with its end E3 will strike the end E5 of the arm member ARM and the movable arm 38 will be directly forced to lift up and separate contact 34 from contact 32, thus, before the toggle mechanism had time to respond to hammer 96.

Figure 6A:
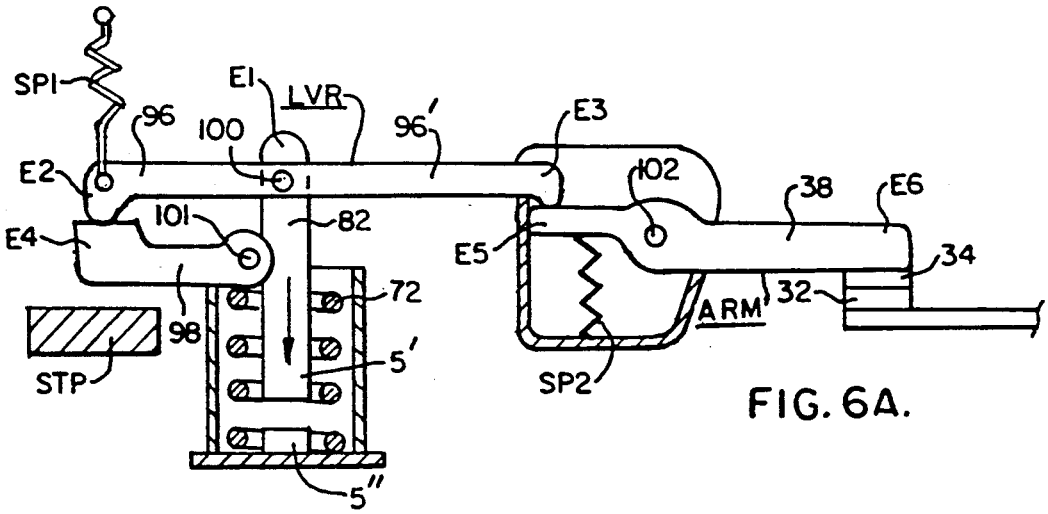
FIGS. 6A, 6B and 6C show at three successive stages the preferred embodiment of the invention with a double-ended lever operating under the electromagnetic means either upon the trip bar or upon the kicker arm, depending upon the urgency.
Figure 6B:
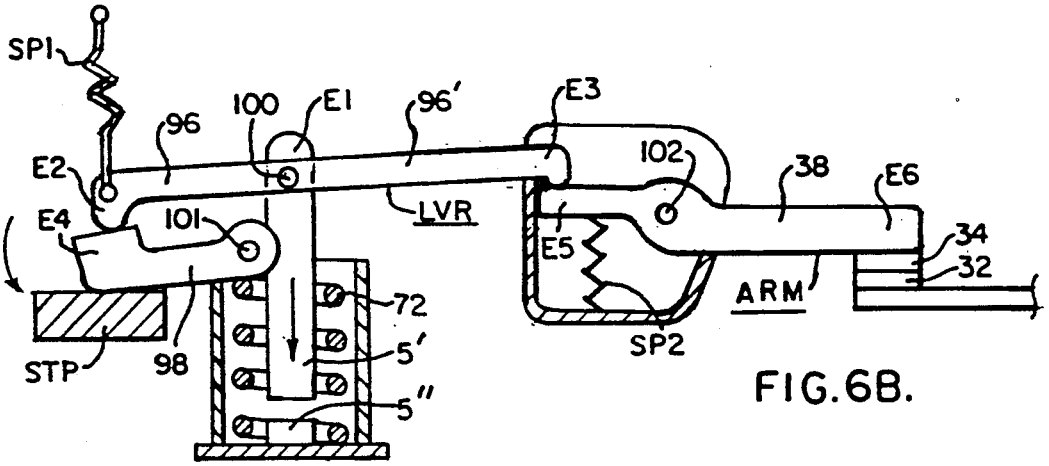
Figure 6C:
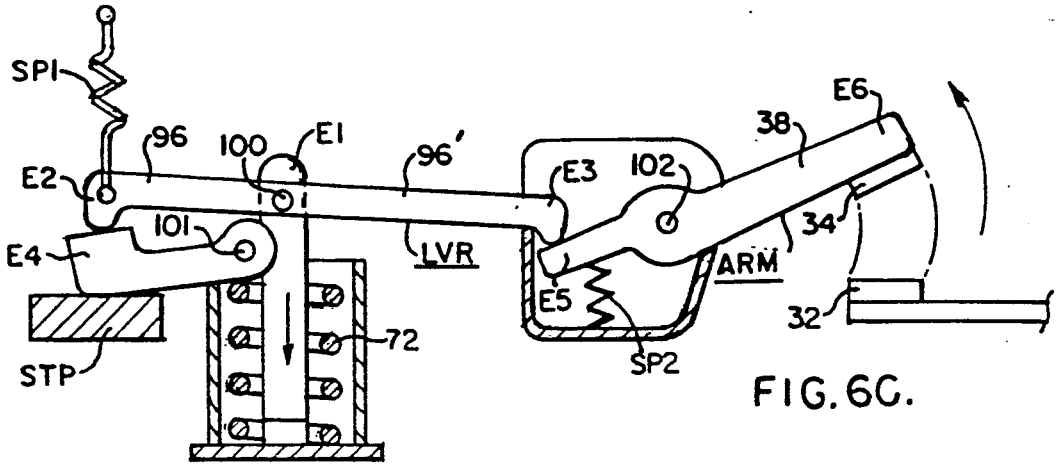

FIGS. 6A, 6B, 6C show the preferred embodiment of the invention. Plunger 82 is now connected by its open end E1 to a double-ended lever LVR having one arm 96 and a second arm 96′ serving about a central pivot 100 the two functions of hammers 96 and 96′ of FIG. 5. FIG. 6A is rest position. The airgap between 5 and 5′ is maximum. Arm 96 by its end E2 rests upon the end E4 of the trip bar 98, under the balancing force of a spring SP1 holding the end E2. Arm 96′ rests by its end E3 against the end E5 of the arm member ARM against the tension of a spring SP2 applied to the arm member. Arm member ARM is mounted on a pivot 102 belonging to the movable arm 38 of the circuit breaker. The opposite end E6 of the arm member ARM carries the movable contact 34. The latter separates from fixed contact 32 when the arm member causes the movable arm to move about pivot 102.

FIG. 6B shows the intermediate position when coil 72 has an overcurrent sufficient to create a smaller airgap between 5 and 5′, but not enough to close the airgap. A stopper STP is provided which upon rotation of the trip bar under hammer 96 to hold the trip bar in position after a certain rotation is sufficient to actuate the toggle mechanism. However, this has no effect on arm member ARM. Spring SP2 holds it at rest. FIG. 6C shows the more extreme situation when a strong current causes the airgap to be closed. Now, the lever LVR rotates altogether about the abutting point of end E4, and the arm member ARM is pushed by end E3 of arm 96′ against spring SP2. The contacts are separated immediately. In other words, the operation of the toggle mechanism after rotation of the trip bar to this blocked position will not be awaited for by the system. The arm member ARM and the movable arm 38 of the circuit breaker are actuated immediately.

We claim:

1. A circuit breaker having a fixed electrical contact and a movable contact carried by a movable arm, a toggle mechanism for moving the movable arm and the movable contact away from the fixed contact, a trip bar for actuating the toggle mechanism, electromagnetic means energized for taking a first position from a rest position and including a plunger operable from a large airgap at said rest position to a smaller airgap for said first position, comprising:

a double-ended lever pivotably carried by said plunger, a first end of said double-ended lever being adapted to engage said trip bar for actuation thereof and a second end of said double-ended lever being adapted to engage said movable arm for actuation thereof, said first end being operative upon said trip bar when said electromagnetic means is in said first position, said electromagnetic means being energizable to take a second position wherein said plunger leaves a substantially zero airgap, and said second end being operative upon said movable arm when said electromagnetic means is in said second position, whereby the movable arm is moved away by said toggle mechanism upon an overcurrent causing the electromagnetic means to take the first position and directly by said double-ended lever second end upon a critical event causing the electromagnetic means to take the second position.

2. The circuit breaker of claim 1 with said first end of the double-ended lever being at rest in front of said trip bar and with said second end resting upon said movable arm when said electromagnetic means is in said rest position, stopper means being provided for stopping said trip bar at a limit position after actuation by said pivotal arm first end, when said electromagnetic means is in said first position.

3. The circuit breaker of claim 2 with said double-ended lever pivoting about said first end when said electromagnetic means moves to said second position, and with said second end forcing upon one end of said movable arm for moving together said movable arm and said movable contact when said double-ended lever rotates about said one end.

4. The circuit breaker of claim 3 with first spring means for holding said double-ended lever first end at rest in front of said trip bar.

5. The circuit breaker of claim 4 with said movable arm carrying an arm member, said second end resting upon said arm member of said movable arm, with second spring means for biasing said arm member against said second end, said second spring means yielding upon said electromagnetic means reaching said second position.

6. The circuit breaker of claim 5 with said electromagnetic means having means for selecting said larger airgap in relation to said critical event.

7. The circuit breaker of claim 6 with said plunger being spring-biased for establishing said larger airgap.

8. The circuit breaker of claim 7 being interposed between AC power lines and an AC motor, said overcurrent being experienced by the AC motor, and with said critical event being a short-circuit.

* * * * *